US009957451B2

(12) United States Patent
Abudawoud

(10) Patent No.: US 9,957,451 B2
(45) Date of Patent: May 1, 2018

(54) TWO-STEP PROCESS FOR AROMATICS PRODUCTION FROM NATURAL GAS/SHALE GAS CONDENSATES

(71) Applicant: Saudi Arabian Oil Company, Dhahran (SA)

(72) Inventor: Raed Abudawoud, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 287 days.

(21) Appl. No.: 14/872,495

(22) Filed: Oct. 1, 2015

(65) Prior Publication Data

US 2016/0097007 A1 Apr. 7, 2016

Related U.S. Application Data

(60) Provisional application No. 62/059,249, filed on Oct. 3, 2014.

(51) Int. Cl.
*C10G 63/00* (2006.01)
*C10G 69/02* (2006.01)
(Continued)

(52) U.S. Cl.
CPC ..... *C10G 69/02* (2013.01); *C10G 59/02* (2013.01); *C10G 63/02* (2013.01); *C10G 69/08* (2013.01); *C10G 69/10* (2013.01); *C10G 2400/30* (2013.01)

(58) Field of Classification Search
CPC .... C10G 2400/30; C10G 59/02; C10G 63/02; C10G 69/02; C10G 69/08; C10G 69/10
See application file for complete search history.

(56) References Cited

U.S. PATENT DOCUMENTS 4,246,094 A 1/1981 McCaulay et al.
5,409,595 A 4/1995 Harandi et al.
(Continued)

FOREIGN PATENT DOCUMENTS

EP 2149594 A1 2/2010
WO 1998036037 8/1998
(Continued)

OTHER PUBLICATIONS

PCT International Search Report and the Written Opinion of the International Searching Authority dated Feb. 9, 2016; International Application No. PCT/US2015/053399; International Filing Date: Oct. 1, 2015.

*Primary Examiner* — Sharon Pregler
(74) *Attorney, Agent, or Firm* — Bracewell LLP; Constance Gall Rhebergen

(57) ABSTRACT

The aromatics production system is useful for producing an aromatics-rich system product from a liquid hydrocarbon condensate includes a hydroprocessing reactor, an aromatization reactor system and a hydrogen extraction unit. The method for producing the aromatics-rich system product from the wide boiling range condensate includes introducing the wide boiling range condensate into the hydroprocessing reactor, operating the aromatics production system such that the hydroprocessing reactor forms a naphtha boiling temperature range liquid product, such that the aromatization reactor system forms the aromatics-rich system product, and such that the hydrogen extraction unit forms a high-purity hydrogen.

16 Claims, 2 Drawing Sheets

(51) Int. Cl.

| | |
|---|---|
| ***C10G 59/02*** | (2006.01) |
| ***C10G 63/02*** | (2006.01) |
| ***C10G 69/08*** | (2006.01) |
| ***C10G 69/10*** | (2006.01) |

(56) References Cited

U.S. PATENT DOCUMENTS

| | | | |
|---|---|---|---|
| 5,993,643 | A | 11/1999 | Chang et al. |
| 6,515,032 | B2 | 2/2003 | Moore, Jr. et al. |
| 7,176,342 | B2 | 2/2007 | Bellussi et al. |
| 7,285,693 | B2 | 10/2007 | Clark |
| 7,534,340 | B2 | 5/2009 | Calemma et al. |
| 8,414,763 | B2 | 4/2013 | da Silva Ferreira Alves et al. |
| 2002/0112990 | A1 | 8/2002 | Iaccino et al. |
| 2005/0252830 | A1 | 11/2005 | Treesh et al. |
| 2011/0147267 | A1 | 6/2011 | Kaul et al. |
| 2013/0020233 | A1 | 1/2013 | Ma et al. |
| 2013/0146508 | A1 | 6/2013 | Quignard et al. |
| 2013/0165719 | A1 | 6/2013 | Negiz et al. |

FOREIGN PATENT DOCUMENTS

| | | | | |
|---|---|---|---|---|
| WO | 20080092232 | A1 | 8/2008 | |
| WO | WO-2008092232 | A1 * | 8/2008 | ..... C10G 35/085 |

* cited by examiner

TWO-STEP PROCESS FOR AROMATICS PRODUCTION FROM NATURAL GAS/SHALE GAS CONDENSATES

BACKGROUND OF THE INVENTION

1. Field of the Invention

The field of invention relates to the production of aromatics. More specifically, the field relates to a system and method for producing aromatics from gas condensates.

2. Description of the Related Art

Traditionally wide boiling range condensates from natural gas, light condensate, natural gas liquid, shale gas, and other gas or liquid hydrocarbon-bearing reservoirs that produce light petroleum liquids ($C_{3-12}$ range) are sent to fractionation columns and are distilled using techniques similar to those used for fractionating crude oil in an atmospheric pressure crude separations tower. The fractionated products—liquefied petroleum gas (LPG), natural gasoline, naphtha, and atmospheric gas oil fractions—are then typically processed for various impurities that occur within each boiling fraction before they are used to produce refined product fuels and petrochemicals, including olefins, gasoline and blending components of gasoline, kerosene and diesel.

Other uses of wide boiling range condensates include feeding the condensate to a steam-cracking reformer or a pyrolysis furnace to crack the material into light olefins, especially $C_{2-4}$ olefins, for direct use in petrochemical manufacturing of polymers and other light olefin derivatives. Another process using a condensate includes combining the condensate material with hydrocarbon stream from a Fischer-Tropsch synthesis process. Both of these processes, however, struggle with handling the impurities that come with the wide boiling range condensate, including sulfur and nitrogen-bearing compounds, and heterorganic species with nickel and vanadium.

It is desirable to find a more direct process for receiving a wide boiling range condensate, which many within the industry consider as an alternative feedstock, from its production source with minimal pre-treatment for conversion into useful petrochemicals, especially aromatic commodity chemicals including benzene, toluene and the xylenes. Such chemicals have a global marketplace and are not limited to local use, unlike light olefins with their high reactivity. It is also desirable to have a system that eliminates the necessity of separating the wide boiling range condensate first into fractional components. As well, there is interest in preventing the build-up of sulfur or metal-based fouling within the processing system regardless of technique.

SUMMARY OF THE INVENTION

An aromatics production system useful for producing an aromatics-rich system product from a wide boiling range condensate includes a hydroprocessing reactor. The hydroprocessing reactor fluidly couples to a hydrogen extraction unit. The hydroprocessing reactor contains a hydroprocessing catalyst. The hydroprocessing reactor is operable to receive the liquid hydrocarbon condensate as well as high-purity hydrogen, and to produce a light product gas mixture and a naphtha boiling temperature range liquid product. The naphtha boiling temperature range liquid product consists of naphtha boiling temperature range liquid product components that have true boiling point temperatures no greater than 220° C. The aromatics production system includes an aromatization reactor system. The aromatization reactor system fluidly couples to the hydroprocessing reactor. The aromatization reactor system contains an aromatization catalyst. The aromatization reactor system is operable to receive the naphtha boiling temperature range liquid product, the non-aromatic liquid product and optionally high-purity hydrogen and to produce the aromatics-rich system product, a hydrogen-rich gas product, and a non-aromatic liquid product, and to selectively separate a liquid product into the aromatics-rich system product and the non-aromatic liquid product. The aromatics in the aromatics-rich system product include benzene, toluene and xylenes. The aromatics production system includes the hydrogen extraction unit. The hydrogen extraction unit fluidly couples to the hydroprocessing reactor and the aromatization reactor system. The hydrogen extraction unit is operable to receive the light product gas mixture and the hydrogen-rich gas product, to selectively separate hydrogen from the introduced gases, and to produce a high-purity hydrogen and a mixed hydrogen-poor gas.

A method for producing the aromatics-rich system product from the wide boiling range condensate includes the step of introducing the wide boiling range condensate and the high-purity hydrogen into the hydroprocessing reactor of the aromatics production system. The volume ratio of the high-purity hydrogen to the wide boiling range condensate introduced into the hydroprocessing reactor is in a range of from about 0.01 to about 10. The method includes the step of operating the aromatics production system such that the hydroprocessing reactor forms both a light product gas mixture and a naphtha boiling temperature range liquid product. The naphtha boiling temperature range liquid product consists of naphtha boiling temperature range liquid product components that have true boiling point temperatures no greater than 220° C. The method includes the step of operating the aromatics production system such that the naphtha boiling temperature range liquid product passes to the aromatization reactor system and the light product gas mixture passes to the hydrogen extraction unit. The method includes the step of operating the aromatics production system such that the aromatization reactor system forms the aromatics-rich system product, a hydrogen-rich gas product and a non-aromatic liquid product, where the non-aromatic liquid product comprises $C_{9+}$ paraffins and naphthenes and contains less than about 5 wt. % aromatics. The method includes the step of operating the aromatics production system such that the hydrogen-rich gas product passes to the hydrogen extraction unit and at least a portion of the non-aromatic liquid product passes to the aromatization reactor system. The method includes the step of operating the aromatics production system such that the hydrogen extraction unit forms the high-purity hydrogen and a mixed hydrogen-poor gas. The mixed hydrogen-poor gas comprises no less than about 70 wt. % $C_{1-5}$ alkanes. The method includes the step of operating the aromatics production system such that the high-purity hydrogen passes to the hydroprocessing reactor.

A two-step process allows for the efficient conversion of hydrocarbon condensates into a product stream rich in benzene, toluene and the xylenes (BTX) and useful light hydrocarbon gases. Benzene and para-xylene are useful petrochemical building blocks for many chemical and polymer materials. Production from an inexpensive and alternative hydrocarbon-bearing fluid is useful for increasing global capacity of these useful petrochemicals.

In the process, wide temperature range condensates, which contain components that boil at temperatures beyond the naphtha boiling temperature range, are upgraded such that a naphtha boiling temperature range liquid product is produced that is suitable for introduction into a catalytic naphtha reformer. Hydrotreating the condensate to remove sulfur and other impurities so that the produced stream can be tolerated by sensitive reforming catalysts and hydrocracking the higher-carbon compounds into naphtha boiling temperature range liquid product makes the processing of the product of the hydrotreater easier for the aromatizing catalyst. The catalytic reformer produces BTX aromatics from the naphtha boiling temperature range liquid product. The process minimizes the loss of light hydrocarbon gases that are useful to reprocess into hydrogen and LPG and maximizes BTX production by recycling unconverted non-aromatic liquid product to oblivion.

Optionally, recycling non-aromatic liquid product selectively separated from the effluent of the aromatization reactor system to the hydroprocessing reactor permits saturation of olefins that may form during the aromatization reaction. Such olefins could negatively affect the performance of naphtha reforming catalysts if directly recycled.

No previous method have been found where condensates are both hydrotreated and hydrocracked to produce naphtha boiling temperature range liquid product suitable for an aromatization reaction. The disclosed process is different from how condensates are known to be processed and reduces the number of steps to convert wide temperature range condensate materials into useful aromatic chemicals.

BRIEF DESCRIPTION OF THE DRAWINGS

So that the manner in which the features, advantages and compositions of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments. The present technology will be better understood on reading the following detailed description of non-limiting embodiments thereof, and on examining the accompanying drawings, in which.

DETAILED DESCRIPTION OF THE INVENTION

Figure 1:
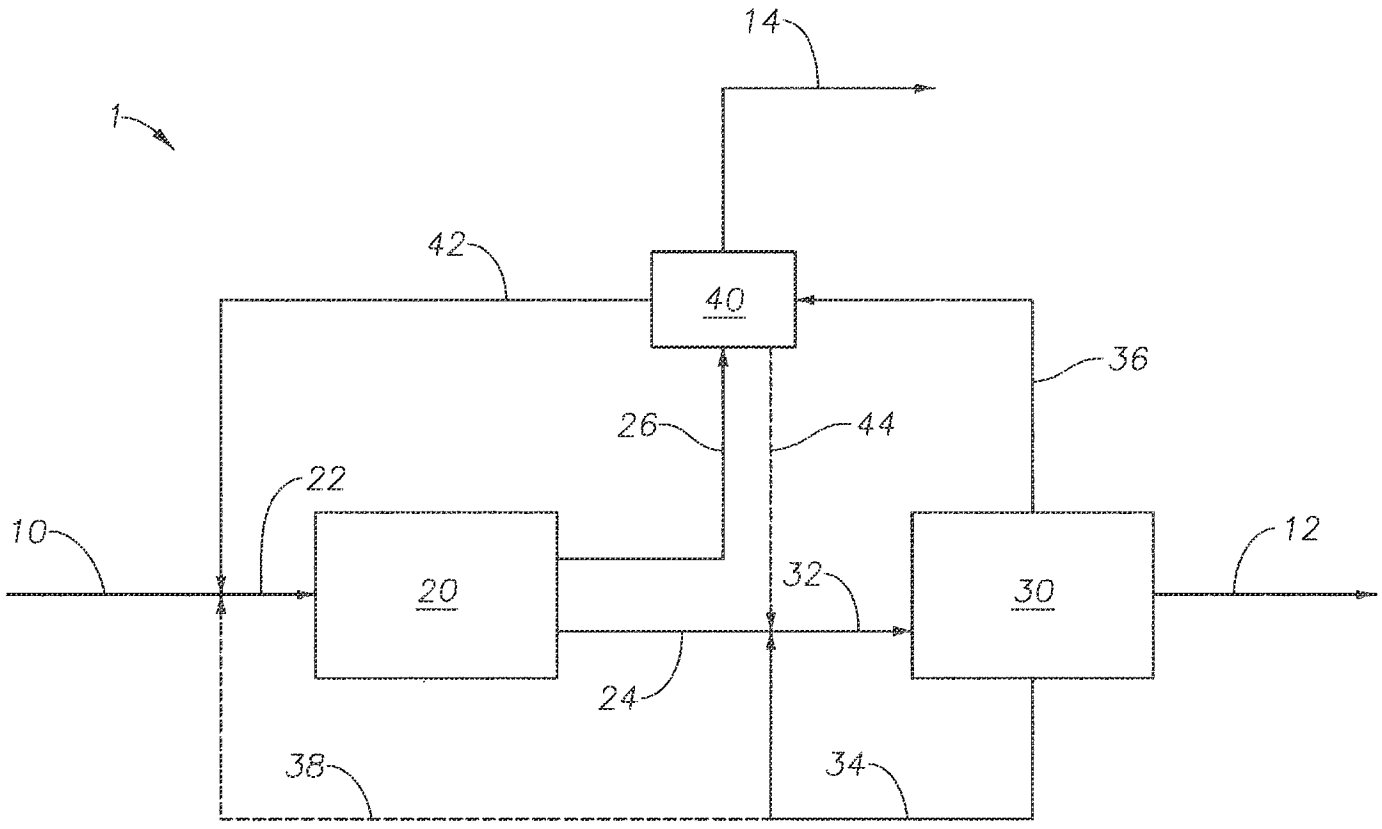
FIG. 1 shows a general process flow diagram for an embodiment of the aromatics production system.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an" and "the" include plural references unless the context clearly indicates otherwise. The verb "comprises" and its conjugated forms should be interpreted as referring to elements, components or steps in a non-exclusive manner, and the invention illustrative disclosed suitably may be practiced in the absence of any element which is not specifically disclosed, including as "consisting essentially of" and "consisting of". The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words, including "upstream", "downstream" and other like terms, are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided. "Substantial" means equal to or greater than 10% by the indicated unit of measure. "Significant" means equal to or greater than 1% of the indicated unit of measure. "Detectable" means equal to or greater than 0.01% by the indicated unit of measure.

Where the Specification and appended Claims reference a method comprising two or more defined steps, the defined steps can be carried out in any order or simultaneously except where the context excludes that possibility.

When a patent or a publication is referenced in this disclosure, the reference is incorporated by reference and in its entirety to the extent that it does not contradict statements made in this disclosure.

FIG. 1

The aromatics production system utilizes wide boiling range condensate to form aromatic products, including benzene, toluene and the xylenes. Wide boiling range condensate is introduced into aromatics production system 1 through condensate feed line 10 from a source upstream and outside of the process. Aromatics production system 1 also passes two useful product streams for downstream petrochemical processing. Aromatics production system 1 passes aromatics product stream 12. Aromatics product stream 12 may actually comprise one or several streams containing mixed or partially-refined benzene, toluene, the xylenes, and combinations thereof. Aromatics production system 1 also passes LPG stream 14. LPG stream 14 is effluent from the hydrogen separation and refining process and contains light alkanes ($C_{1-4}$) and a reduced amount of hydrogen. The mixed hydrogen-poor gases of LPG stream 14 are useful for additional refining (for example, hydrogen extraction) and as a high BTU boiler feed for steam and electricity generation outside of aromatics production system 1.

The wide boiling range condensate is introduced into hydroprocessing reactor 20 using combined feed line 22. As shown in FIG. 1, two other streams combine with condensate feed line 10 to form combined feed line 22. Refined hydrogen recycle line 42 couples hydrogen extraction unit 40 to hydroprocessing reactor 20 and conveys high-purity hydrogen from hydrogen extraction unit 40 to hydroprocessing reactor 20. The aromatics production system is operated such that the volume ratio of the high-purity hydrogen to the wide boiling range condensate introduced into the hydroprocessing reactor is in a range of from about 0.01 to about 10. Optionally, hydroprocessing reactor 20 couples to aromatization reactor system 30 using non-aromatics liquid recycle line 38, which is operable to convey at least a portion of the non-aromatic liquid product from the aromatics conversion process of aromatization reactor system 30 back to hydroprocessing reactor 20. Although shown as a combined stream, each of condensate feed line 10, non-aromatics liquid recycle line 38 and refined hydrogen recycle line 42 can in another embodiment of the system feed directly into hydroprocessing reactor 20 without pre-combining into combined feed line 22.

In the hydroprocessing reactor, the wide boiling range condensate, high-purity hydrogen, and optional non-aromatic liquid product contact at least one hydroprocessing catalyst bed containing a hydroprocessing catalyst in hydroprocessing reactor 20. Useful hydroprocessing catalysts include catalysts described in U.S. Pat. No. 5,993,643 (issued Nov. 30, 1999), U.S. Pat. No. 6,515,032 (issued Feb. 4, 2003) and U.S. Pat. No. 7,462,276 (issued Dec. 9, 2008).

The combined feeds contact the hydroprocessing catalyst at hydroprocessing conditions such that several reactions occur simultaneously. At the hydroprocessing conditions, the hydrocracking reactor is operable to remove organic sulfur, nitrogen and metal compounds using the introduced high-purity hydrogen and the hydroprocessing catalyst to form gases and metal solids such as hydrogen sulfide and ammonia. If the non-aromatic liquid product is also recycled to the hydroprocessing reactor, any introduced olefins are saturated to paraffins by the high-purity hydrogen. The hydroprocessing reactor also operates at a hydrocracking severity such that introduced paraffins, naphthenes and aromatics having a true boiling point (TBP) temperature greater than about 220° C. are cracked and saturated into paraffins having a TBP temperature within the naphtha boiling temperature range, which is from about 30° C. to about 220° C. The product composition does not have any hydrocarbon components, but especially paraffins, that have a TBP temperature greater than what is traditionally considered the highest temperature in the naphtha boiling range (about 233° C.). This also ensures that the hydrotreated and partially-hydrocracked hydrocarbon product is mostly paraffinic. In an embodiment of the method, the aromatics production system is operated such that the temperature within the hydroprocessing reactor is maintained in a range of from about 200° C. to about 600° C. In an embodiment of the method, the aromatics production system is operated such that the pressure within the hydroprocessing reactor is maintained in a range of from about 10 bars to about 200 bars. In an embodiment of the method, the aromatics production system is operated such that the liquid hourly space velocity (LHSV) within the hydroprocessing reactor is maintained in a range of from about 0.1 $hours^{-1}$ to about 20 $hours^{-1}$.

Hydroproces sing reactor is operable to form a light product gas mixture and naphtha boiling temperature range liquid product from the hydroprocessing of the wide boiling range condensate, high-purity hydrogen and the optional non-aromatic liquid product. The naphtha boiling temperature range liquid product consists of naphtha boiling temperature range liquid product components that have true boiling point temperatures no greater than about 220° C. The naphtha boiling temperature range liquid product components include paraffins and optionally significant amount of aromatics or naphthenes, or both. The naphtha boiling temperature range liquid product can have a boiling point temperature range in a range of from about 30° C. to about 220° C. The volume ratio of the stream passing the naphtha boiling temperature range liquid product versus the stream introducing the wide boiling range condensate is about 4:5, showing that the cracking reactions increase the volume of the fluids being processed. Liquid product stream 24 couples hydroprocessing reactor 20 to aromatization reactor system 30, and the naphtha boiling temperature range liquid product passes from hydroprocessing reactor 20 to aromatization reactor system 30. The light product gas mixture is predominantly a mixture of hydrogen and light ($C_{1-5}$) alkanes, and may contain lesser amounts of hydrogen sulfide, ammonia, and water. In an embodiment of the method, the aromatics production system is operated such that the light product gas mixture comprises hydrogen in a range of from about 0 wt. % to about 50 wt. % of the light product gas mixture. Light products stream 26 couples hydroprocessing reactor 20 to hydrogen extraction unit 40, and the light product gas mixture passes from hydroprocessing reactor 20 to hydrogen extraction unit 40.

FIG. 1 shows aromatics production system 1 introducing the naphtha boiling temperature range liquid product into aromatization reactor system 30 using combined feed line 32. Non-aromatics liquid recycle line 34 combines with liquid product stream 24 to form combined feed line 32. Non-aromatics liquid recycle line 34 reintroduces at least some of the non-aromatic liquid product passing from aromatization reactor system 30 back to the front of aromatization reactor system 30. In an embodiment of the method, the aromatics production system is operated such that the weight percentage of the non-aromatic liquid product introduced into the aromatization reactor system is in a range of from about 10 wt. % to about 50 wt. % of the feeds to the aromatization reactor system. The aromatics production system is operated such that the non-aromatic liquid product produced by the aromatization reactor system comprises $C_{9+}$ paraffins and naphthenes and less than about 5 wt. % aromatics. In an embodiment of the method, the aromatics production system is operated such that there is a significant amount of olefins in the non-aromatic liquid product.

Non-aromatics liquid recycle line 34 passes at least a portion of the separated non-aromatic liquid product, which includes a variety of paraffins and naphthenes, back to combined feed line 32 such that they can be processed again into aromatics in aromatization reactor system 30. In an embodiment of the method, the aromatics production system is operated such that the all of the non-aromatic liquid product produced by the aromatization reactor system is reintroduced into the aromatization reactor system. In an embodiment of the method, the aromatics production system is operated such that at least a portion of the non-aromatic liquid product passes to the hydroprocessing reactor. FIG. 1 shows an optional routing of at least a portion of the non-aromatic liquid product passing to hydroprocessing reactor 20 via non-aromatics liquid recycle line 38 (dashed). The purpose of passing at least a portion of the non-aromatic liquid product back to the hydroprocessing reactor when it contains olefins is to permit saturation of the olefins as redirecting olefins back into the aromatization reactor system can foul the aromatizing catalyst.

Optionally, aromatization reactor system 30 couples to hydrogen extraction unit 40 using hydrogen line 44 (dashed) such that hydrogen extraction unit 40 can convey high-purity hydrogen to aromatization reactor system 30. In an embodiment of the method, the aromatics production system is operated such that high-purity hydrogen is introduced into the aromatization reactor system. In such an embodiment, the volume ratio of the high-purity hydrogen to the feeds introduced into the aromatization reactor system is maintained in a range of from about 0.01 to about 6. Although shown as a combined stream, each of liquid product stream 24, non-aromatics liquid recycle line 34 and hydrogen line 44 can in another embodiment of the system feeds directly into aromatization reactor system 30 without pre-combining into combined feed line 32.

In the aromatization reactor system, the naphtha boiling temperature range liquid product and at least part of the non-aromatic liquid product contact at least one aromatization catalyst bed containing an aromatization catalyst. The catalyst bed can be a moving bed or fixed bed reactor. Useful aromatization catalysts include any selective naphtha reforming catalyst, including catalysts described in PCT Pat. App. Pub. No WO 1998/036037 A1 (published Aug. 20, 1998).

The combined feeds contact the aromatization catalyst at aromatization conditions such that several reactions occur simultaneously. At the aromatization conditions, the aromatization reactor system is operable to convert the naphtha boiling temperature range liquid product and the at least part of the non-aromatic liquid product into a liquid product, where the aromatics produced are within the $C_{6-8}$ range, and a hydrogen-rich gas product. In an embodiment of the method, the aromatics production system is operated such that the temperature within the aromatization reactor system is maintained in a range of from about 200° C. to about 600° C. In an embodiment of the method, the aromatics production system is operated such that the pressure within the aromatization reactor system is maintained in a range of from about 1 bar to about 80 bars. In an embodiment of the method, the aromatics production system is operated such that the liquid hourly space velocity (LHSV) within the aromatization reactor system is maintained in a range of from about 0.5 $hours^{-1}$ to about 20 $hours^{-1}$. The aromatization reactor system is also operable to selectively separate the liquid product into an aromatics-rich system product and a non-aromatic liquid product such that the non-aromatic liquid product can be recycled. Chemical extraction or distillation, or a combination of the two, can be used within the aromatization reactor system to selectively separate the non-aromatics from the aromatics.

Aromatics product stream 12 passes the aromatics-rich system product, which is rich in benzene, toluene and the xylenes, downstream for additional processing and separations outside of aromatics production system 1, including petrochemical processing. In an embodiment of the method, the aromatics production system is operated such that the conversion rate of the feeds introduced into the aromatization reactor system into the aromatics-rich system product is in a range of from about 50% to about 90% of the introduced feeds. In an embodiment of the method, the aromatics production system is operated such that the first-pass conversion rate of the introduced wide boiling range condensate into the aromatics-rich system product is in a range of from about 40% to about 72% of the introduced wide boiling range condensate.

The aromatics-rich system product has less than a detectable amount of paraffins, naphthalenes and olefins. In an embodiment of the method, the aromatics production system is operated such that the aromatics-rich system product comprises benzene in a range of from about 2 wt. % to about 30 wt. % of the aromatics-rich system product. In an embodiment of the method, the aromatics production system is operated such that the aromatics-rich system product comprises toluene in a range of from about 10 wt. % to about 40 wt. % of the aromatics-rich system product. In an embodiment of the method, the aromatics production system is operated such that the aromatics-rich system product comprises the xylenes in a range of from about 8 wt. % to about 30 wt. % of the aromatics-rich system product.

The hydrogen-rich gas product is an unrefined mixture of hydrogen and light alkanes ($C_{1-5}$) produced from the aromatization process of the paraffins fed into aromatization reactor system. In an embodiment of the method, the aromatics production system is operated such that the ratio of hydrogen-rich gas product to the feeds introduced into the aromatization reaction system is about 3:10 by weight. Light products stream 36 couples aromatization reactor system 30 to hydrogen extraction unit 40, and the hydrogen-rich gas product passes from aromatization reactor system 30 to hydrogen extraction unit 40.

FIG. 1 shows aromatics production system 1 introducing into hydrogen extraction unit 40 both the light product gas mixture from hydroprocessing reactor 20 using light products stream 26 and the hydrogen-rich gas product from aromatization reactor system 30 using light products stream 36. Both light products stream 26 and light products stream 36 provide hydrogen and light alkanes that are selectively separated in hydrogen extraction unit 40. Although not shown as a combined stream, in another embodiment of the system both light products stream 26 and light products stream 36 may be combined into a single stream and fed directly into hydrogen extraction unit 40.

Hydrogen extraction unit 40 is operable to selectively separate the hydrogen from the two product gas mixtures such that high-purity hydrogen and a mixed hydrogen-poor gas form. The hydrogen extraction unit can be a pressure-swing adsorption (PSA) system, extractive distillation, solvent extraction, or membrane separation. The configuration of the hydrogen extraction unit reflects the volume and purity of the hydrogen. In an embodiment of the method, the aromatics production system is operated such that the high-purity hydrogen produced from the feeds introduced to the hydrogen extraction unit is in a range of from about 35 wt. % to about 90 wt. % of the feeds to the hydrogen extraction unit. FIG. 1 shows aromatics production system 1 passing the high-purity hydrogen to hydroprocessing reactor 20 via refined hydrogen recycle line 42 and combined feed line 22. Optionally, a small amount of high-purity hydrogen may be supplied to aromatization reactor system 30 to facilitate the aromatization reactions via hydrogen line 44. LPG stream 14 passes the mixed hydrogen-poor gases for processing outside of aromatics production system 1, including distribution as an LPG fuel or internal plant combustion and power generation. The aromatics production system is operated such that the mixed hydrogen-poor gas comprises no less than about 70 wt. % $C_{1-5}$ alkanes.

Wide Boiling Range Condensate

An example of two useful wide boiling range condensates that originate from two natural gas production wells are presented in Table 1. As previously described, the wide boiling range condensate can originate from natural hydrocarbon-bearing sources such as natural gas reservoirs, light condensate reservoirs, natural gas liquids, shale gas and other gas or liquid hydrocarbon-bearing reservoirs that produce a light petroleum liquid in the $C_{3-12}$ range.

Wide boiling range condensates contain sulfur-bearing heterorganic compounds in a range of from about 200 ppm to about 600 ppm on a sulfur-weight basis, including hydrogen sulfide and aliphatic mercaptans, sulfides and disulfides. The compounds are converted into hydrogen sulfide in the hydroprocessing reactor.

The wide boiling range condensate also contain smaller quantities of nitrogen-bearing compounds, including pyridines, quinolones, isoquinolines, acridines, pyrroles, indoles, carbazoles, metal-bearing heterorganic compounds, which can include vanadium, nickel, cobalt and iron, and salts from brines, which can include sodium, calcium and magnesium. Vanadium is known to be a poison to hydroprocessing catalysts. Total metals are limited in the wide boiling range condensates to no more than about 5 ppm wt. % on a metal-weight basis.

Basic nitrogen measures total pyridines, quinolones, isoquinolines and acridines and is limited in the wide boiling range condensates to no more than about 600 ppm wt. % on a nitrogen-weight basis.

Wide boiling range condensates comprise substantial amounts of paraffins, naphthenes and aromatics while having less than a detectable amount of olefins. In an embodiment of the method, the wide boiling range condensate comprises paraffins in a range of from about 60 wt. % to about 100 wt. % of the wide boiling range condensate. In an embodiment of the method, the wide boiling range condensate comprises naphthenes in a range of from about 60 wt. % to about 100 wt. % of the wide boiling range condensate. In an embodiment of the method, the wide boiling range condensate comprises aromatics in a range of from about 0 wt. % to about 40 wt. % of the wide boiling range condensate.

Useful condensates include material that has a true boiling point distillation temperature in a range that is within the naphtha boiling temperature range. As shown in Table 1, both condensates have about 30 wt. % of the total material having a true boiling point temperature greater than about 233° C. This indicates that the about 30 wt. % of the condensates in Table 1 is gas oil boiling point temperature range materials, which are useful for making diesel fuel. In an embodiment of the method, a portion of the wide boiling range condensate has true boiling point (TBP) temperatures greater than 233° C. In a further embodiment of the method, the portion comprises up to about 75 wt. % of the wide boiling range condensate. In an embodiment of the method, the wide boiling range condensate has a final boiling point (FBP) temperature in a range of from about 400° C. to about 565° C.

Both condensates also appear to have portions of the condensates that comprise about 5 wt. % of the total material that have a true boiling point temperature less than about 25° C. This portion of the condensates is useful to collect as LPG. In an embodiment of the method, a portion of the wide boiling range condensate has true boiling point (TBP) temperatures less than 25° C. In a further embodiment of the method, the portion comprises up to about 20 wt. % of the wide boiling range condensate.

TABLE 1

Two examples of useful wide boiling range condensates

| | Hydrocarbon Stream | |
|---|---|---|
| | Natural Gas Condensate No. 1 | Natural Gas Condensate No. 2 |
| Sulfur (ppm wt. %) | 271 | 521 |
| Metals (ppb wt. %) | | |
| V | <20 | <20 |
| Ni | <20 | <20 |
| Fe | <20 | <20 |
| Cu | <20 | 395 |
| Na | 50 | 110 |
| Hg | — | <1 |
| As | — | <1 |
| Basic Nitrogen (ppm wt. %) | <10 | <10 |
| PIONA Analysis | | |
| Paraffins (wt. %) | 63.9 | 63.2 |
| Olefins (wt. %) | 0 | 0 |
| Naphthenes (wt. %) | 21.3 | 21.7 |
| Aromatics (wt. %) | 14.8 | 15.1 |
| True Boiling Point (TBP) Analysis | | |
| wt. % of Total Material | ° C. | ° C. |
| 5 | 24 | 25 |
| 10 | 57 | 63 |
| 20 | 91 | 94 |
| 30 | 112 | 112 |
| 40 | 138 | 139 |
| 50 | 163 | 164 |
| 60 | 195 | 196 |
| 70 | 233 | 233 |
| 80 | 273 | 271 |
| 90 | 342 | 339 |
| Final Boiling Point (FBP) Temperature | 478 | 482 |

The wide boiling range condensate, including the two materials presented in Table 1, potentially can make good feedstock for catalytic naphtha reforming process, including aromatization, except for several issues that are addressable before introduction into an aromatization process. Removal of the heterorganic sulfur and metal compounds will preserve the quality of the reforming catalyst. Hydrocracking of the high-boiling point materials—the materials that have a TBP temperature greater than about 233° C.—into lighter, naphtha boiling temperature range liquids makes the processing of the hydrocarbon liquids less energy and hydrogen-intensive. Removing the lightest materials—the materials that have a true boiling point temperature less than about 25° C.—will reduce the size/volume of the equipment used for catalytic naphtha reforming as this portion of the condensate acts as a diluent for the process. In addition, these light materials require greater amounts of energy to hydrocrack than hydrocarbons with greater carbon content; therefore, reduced processing temperatures may be used to perform the same hydrocracking operation on greater concentrations of larger carbon content material.

EXAMPLE

The following example is included to demonstrate preferred embodiments of the invention. It should be appreciated by those of skill in the art that the techniques and compositions disclosed in the examples which follow represent techniques and compositions discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or a similar result without departing from the spirit and scope of the invention.

Example 1

In accordance with embodiments of the present invention, a crude conditioner was modelled using the HYSYS Hydroprocessing Model, which may incorporate kinetic processes for both hydrotreating and hydrocracking reactions involving hydrocarbons. The crude conditioner model was calibrated to match crude conditioner pilot plant test data obtained from earlier trials. The crude conditioner model unit may be used to evaluate and predict properties associated with crude oil and natural gas refinement and treatment, including but not limited to Arab Extra Light (AXL) crude oil and Kuff Gas Condensate (KGC) upgrading and improvement.

AXL crude oil, KGC and hydrogen gas were fed to the crude conditioner. The conditioning of the feed streams is performed using a calibrated HYSYS kinetic model. The HYSYS model includes three reactor beds, a high pressure separator, a recycle compressor and a hydrogen recycle loop, ensuring that the calibration takes into account both the reactors and the hydrogen recycle loop as shown in FIG. 2.

Figure 2:
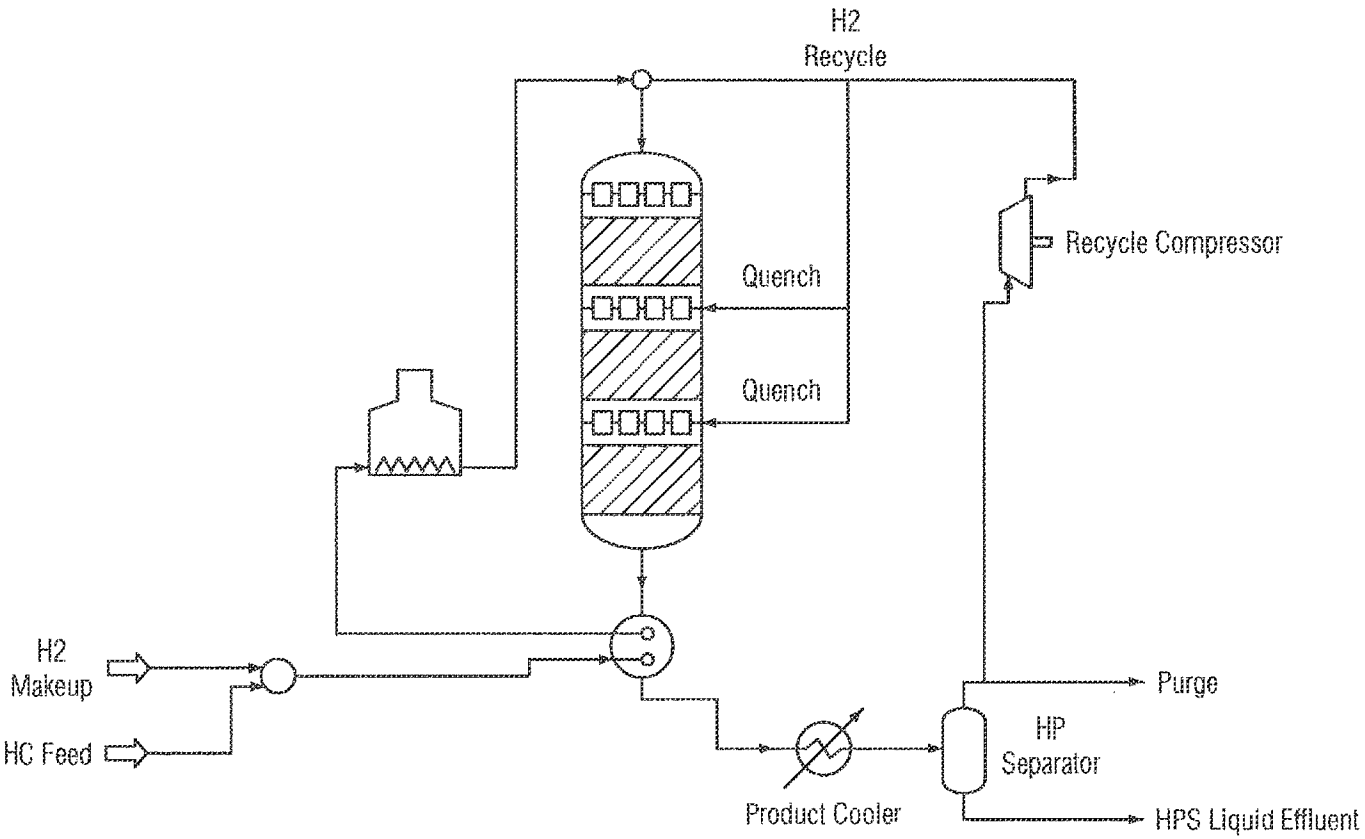
FIG. 2 shows a hydrocarbon processing unit in accordance with some embodiments of the present invention.

As shown in FIG. 2, high pressure separation gas from the high pressure separator and the HPS liquid effluent exit into a main flowsheet, where the liquid from the high pressure separator proceeds to a component splitter comprising a hydrogen sulfide ($H_2S$) absorber and all $H_2S$ as well as hydrogen ($H_2$), ammonia ($NH_3$) and water ($H_2O$) are removed. The resulting liquid hydrocarbon stream is sent to a component splitter where the effluent is separated into hydrogen fractions based on total boiling point (TBP) temperatures for the hydrocarbon stream cut points and the resulting yields are calculated.

In some embodiments, the HYSYS hydroprocessing model described herein uses a set of 142 variables or "pseudocomponents" to characterize one or more feedstocks that may comprise compounds such as hydrogen gas and increase in molecular complexity, for example hydrocarbon compounds containing up to about 50 carbon atoms, including 47 carbon atoms. The "pseudocomponents" components, in certain embodiments, are used to model a series of reaction pathways, alternative referred to as a "reaction network", that may comprise up to about 200 reaction pathways, including a model comprising a series of 177 reaction pathways. The components and reaction network(s) described herein are consistent with hydroprocessing reactions known to those of skill in the art.

The compounds comprising the light gas (C3 (propane) and lighter) were calculated as methane, ethane and propane and related derivatives in the modeling described herein. For hydrocarbon species in the C4 (butane) to C10 (decane) range, one pure component was used to represent several isomers. For example, the properties associated with n-butane were used to represents the properties for both n-butane and iso-butane. For hydrocarbon compounds with a greater number of carbon atoms, compounds with carbon numbers of 14, 18, 26, and 47 were used, as these values were found to represent a wide range of boiling point components in higher (greater than 10 carbon atoms) hydrocarbon compound fractions.

The components used in the hydroprocessing model described herein also comprise different classes of hydrocarbons including monocyclic (one-ring) to tetracyclic (four-ring) carbon species including aromatics and naphthenics. 13 sulfur components were used to represent the sulfur compound distribution in the feed, while 10 basic and non-basic nitrogen components were utilized. The HYSYS hydroprocessing model described herein does not track metals such as transition metal complexes or ashphaltenes and thus these compounds were excluded from modeling. The AXL crude oil (Table 2) and KGC (Table 3) assay feed fingerprint results are shown in Tables 2 and 3:

TABLE 2

AXL Crude Oil Assay Results

| AXL Crude Oil Feed TBP Cut Yield | AXL Crude Oil Assay Simulation Result (Weight %) |
|---|---|
| C1-C4 (less than 70° C.) | 3.4% |
| C5 (Naphtha 1; about 70° C.) | 4.3% |
| Naphtha 2 (70° C.-180° C.) | 24.8% |
| Kerosene (180° C.-220° C.) | 8.4% |
| Diesel (220° C.-350° C.) | 24.1% |
| Vacuum Gas Oil (350° C.-540° C.) | 18.4% |
| Heavy Hydrocarbon Residue (>540° C.) | 16.5% |
| **AXL Crude Oil Chemical Species** | **Weight % Per Fraction** |
| Paraffins in C5 (Naphtha 1; about 70° C.) | 94% |
| Naphthenes in C5 (Naphtha 1; about 70° C.) | 5% |
| Aromatics in C5 (Naphtha 1; about 70° C.) | 1% |
| Paraffins (Naphtha 2; 70° C.-180° C.) | 64% |
| Naphthenes (Naphtha 2; 70° C.-180° C.) | 19% |
| Aromatics (Naphtha 2; 70° C.-180° C.) | 17% |
| Paraffins (Kerosene; 180° C.-220° C.) | 53% |
| Naphthenes (Kerosene; 180° C.-220° C.) | 22% |
| Aromatics (Kerosene; 180° C.-220° C.) | 25% |
| Paraffins (Diesel; 220° C.-350° C.) | 42% |
| Naphthenes (Diesel; 220° C.-350° C.) | 33% |
| Aromatics (Diesel; 220° C.-350° C.) | 26% |
| Paraffins (Vacuum Gas Oil; 350° C.-540° C.) | 34% |
| Naphthenes (Vacuum Gas Oil; 350° C.-540° C.) | 29% |
| Aromatics (Vacuum Gas Oil; 350° C.-540° C.) | 36% |
| Paraffins (Heavy Hydrocarbon Residue; >540° C.) | 13% |
| Naphthenes (Heavy Hydrocarbon Residue; >540° C.) | 24% |
| Aromatics (Heavy Hydrocarbon Residue; >540° C.) | 62% |

TABLE 3

KGC Assay Results

| KGC Feed TBP Cut Yield | KGC Assay Simulation Result (Weight %) |
|---|---|
| C1-C4 (less than 70° C.) | 2.4% |
| C5 (Naphtha 1; about 70° C.) | 10.7% |
| Naphtha 2 (70° C.-180° C.) | 45.7% |
| Kerosene (180° C.-220° C.) | 11.6% |
| Diesel (220° C.-350° C.) | 22.4% |
| Vacuum Gas Oil (350° C.-540° C.) | 6.5% |
| Heavy Hydrocarbon Residue (>540° C.) | 0.6% |
| **KGC Chemical Species** | |
| Paraffins in C5 (Naphtha 1; about 70° C.) | 90% |
| Naphthenes in C5 (Naphtha 1; about 70° C.) | 9% |
| Aromatics in C5 (Naphtha 1; about 70° C.) | 1% |

TABLE 3-continued

| KGC Assay Results | KGC Assay Simulation Result (Weight %) |
|---|---|
| Paraffins (Naphtha 2; 70° C.-180° C.) | 59% |
| Naphthenes (Naphtha 2; 70° C.-180° C.) | 25% |
| Aromatics (Naphtha 2; 70° C.-180° C.) | 15% |
| Paraffins (Kerosene; 180° C.-220° C.) | 51% |
| Naphthenes (Kerosene; 180° C.-220° C.) | 23% |
| Aromatics (Kerosene; 180° C.-220° C.) | 25% |
| Paraffins (Diesel; 220° C.-350° C.) | 47% |
| Naphthenes (Diesel; 220° C.-350° C.) | 35% |
| Aromatics (Diesel; 220° C.-350° C.) | 18% |
| Paraffins (Vacuum Gas Oil; 350° C.-540° C.) | 42% |
| Naphthenes (Vacuum Gas Oil; 350° C.-540° C.) | 36% |
| Aromatics (Vacuum Gas Oil; 350° C.-540° C.) | 22% |
| Paraffins (Heavy Hydrocarbon Residue; >540° C.) | 13% |
| Naphthenes (Heavy Hydrocarbon Residue; >540° C.) | 15% |
| Aromatics (Heavy Hydrocarbon Residue; >540° C.) | 15% |

The crude conditioner model was used to predict the AXL and KGC assay hydroprocessing results. The comparison between the untreated and hydroprocessed AXL crude oil (Table 4) and KGC (Table 5) results are as follows:

TABLE 4

| Comparison Between Untreated and (CCU) Hydroprocessed AXL Crude Oil Results | AXL Before Processing | AXL after Crude Conditioner Unit After Processing |
|---|---|---|
| Crude Conditioner Operation Conditions | | |
| Liquid Hourly Space Velocity (LHSV; $h^{-1}$) | | 0.5 |
| Temperature | | 390° C. |
| Pressure | | 150 bar |
| $H_2$/Oil Ratio, L/L | | 1200 |
| AXL Feed TBP Cut Yields, Weight % | | |
| $H_2$ Consumption | — | 1.97% |
| $H_2S$ | — | 2.0% |
| $NH_3$ | — | 0.1% |
| C1-C4 (less than 70° C.) | 3.4% | 2.9% |
| C5 (Naphtha 1; about 70° C.) | 4.3% | 4.8% |
| Naphtha 2 (70° C.-180° C.) | 24.8% | 24.1% |
| Kerosene (180° C.-220° C.) | 8.4% | 11.4% |
| Diesel (220° C.-350° C.) | 24.1% | 26.9% |
| Vacuum Gas Oil (350° C.-540° C.) | 18.4% | 18.4% |
| Heavy Hydrocarbon Residue (>540° C.) | 16.5% | 11.5% |
| C5+ Liquid Yield | | 97.1% |
| Feed TBP Cut PNA Fingerprint results | | |
| Paraffins in C5 (Naphtha 1; about 70° C.) | 94 | 88 |
| Naphthenes in C5 (Naphtha 1; about 70° C.) | 5 | 12 |
| Aromatics in C5 (Naphtha 1; about 70° C.) | 1 | 0 |
| C/H ratio | 5.15 | 5.22 |
| Paraffins (Naphtha 2; 70° C.-180° C.) | 64 | 48 |
| Naphthenes (Naphtha 2; 70° C.-180° C.) | 19 | 20 |
| Aromatics (Naphtha 2; 70° C.-180° C.) | 17 | 32 |
| C/H ratio | 5.94 | 7.09 |
| Paraffins (Kerosene; 180° C.-220° C.) | 53 | 38 |
| Naphthenes (Kerosene; 180° C.-220° C.) | 22 | 25 |
| Aromatics (Kerosene; 180° C.-220° C.) | 25 | 37 |
| C/H ratio | 6.47 | 7.49 |
| Paraffins (Diesel; 220° C.-350° C.) | 42 | 37 |
| Naphthenes (Diesel; 220° C.-350° C.) | 33 | 23 |
| Aromatics (Diesel; 220° C.-350° C.) | 26 | 40 |
| C/H ratio | 6.51 | 7.09 |
| Paraffins (Vacuum Gas Oil; 350° C.-540° C.) | 34 | 20 |
| Naphthenes (Vacuum Gas Oil; 350° C.-540° C.) | 29 | 22 |

TABLE 4-continued

| Comparison Between Untreated and (CCU) Hydroprocessed AXL Crude Oil Results | AXL Before Processing | AXL after Crude Conditioner Unit After Processing |
|---|---|---|
| Aromatics (Vacuum Gas Oil; 350° C.-540° C.) | 36 | 58 |
| C/H ratio | 6.80 | 7.34 |
| Paraffins (Heavy Hydrocarbon Residue; >540° C.) | 13 | 57 |
| Naphthenes (Heavy Hydrocarbon Residue; >540° C.) | 24 | 15 |
| Aromatics (Heavy Hydrocarbon Residue; >540° C.) | 62 | 27 |
| C/H ratio | 7.42 | 6.20 |

TABLE 5

| Comparison Between Untreated and (CCU) Hydroprocessed KGC Results | KGC | KGC after Crude Conditioner Unit |
|---|---|---|
| Crude Conditioner Operation Conditions | | |
| Liquid Hourly Space Velocity (LHSV; $h^{-1}$) | | 0.5 |
| Temperature | | 390° C. |
| Pressure | | 150 bar |
| $H_2$/Oil Ratio, L/L | | 1200 |
| TBP Cut Yields, Weight % | | |
| $H_2$ Consumption | — | 1.81% |
| $H_2S$ | — | 1.60% |
| $NH_3$ | — | 0.1% |
| C1-C4 (less than 70° C.) | 2.4% | 2.8% |
| C5 (Naphtha 1; about 70° C.) | 11.8% | 11.1% |
| Naphtha 2 (70° C.-180° C.) | 46.2% | 48.7% |
| Kerosene (180° C.-220° C.) | 9.5% | 9.6% |
| Diesel (220° C.-350° C.) | 22.7% | 22.2% |
| Vacuum Gas Oil (350° C.-540° C.) | 6.6% | 5.1% |
| Heavy Hydrocarbon Residue (>540° C.) | 0.9% | 0.5% |
| C5+ Liquid Yield | | 97.2% |
| Feed TBP Cut PNA Fingerprint results | | |
| Paraffins in C5 (Naphtha 1; about 70° C.) | 90 | 80 |
| Naphthenes in C5 (Naphtha 1; about 70° C.) | 9 | 20 |
| Aromatics in C5 (Naphtha 1; about 70° C.) | 1 | 0 |
| C/H ratio | 5.16 | 5.29 |
| Paraffins (Naphtha 2; 70° C.-180° C.) | 59 | 33 |
| Naphthenes (Naphtha 2; 70° C.-180° C.) | 25 | 23 |
| Aromatics (Naphtha 2; 70° C.-180° C.) | 15 | 43 |
| C/H ratio | 6.00 | 7.64 |
| Paraffins (Kerosene; 180° C.-220° C.) | 51 | 32 |
| Naphthenes (Kerosene; 180° C.-220° C.) | 23 | 2 |
| Aromatics (Kerosene; 180° C.-220° C.) | 25 | 66 |
| C/H ratio | 6.43 | 8.54 |
| Paraffins (Diesel; 220° C.-350° C.) | 47 | 15 |
| Naphthenes (Diesel; 220° C.-350° C.) | 35 | 46 |
| Aromatics (Diesel; 220° C.-350° C.) | 18 | 39 |
| C/H ratio | 6.49 | 7.64 |
| Paraffins (Vacuum Gas Oil; 350° C.-540° C.) | 42 | 1 |
| Naphthenes (Vacuum Gas Oil; 350° C.-540° C.) | 36 | 30 |
| Aromatics (Vacuum Gas Oil; 350° C.-540° C.) | 22 | 69 |
| C/H ratio | 6.42 | 7.62 |
| Paraffins (Heavy Hydrocarbon Residue; >540° C.) | 13 | 20 |
| Naphthenes (Heavy Hydrocarbon Residue; >540° C.) | 15 | 10 |
| Aromatics (Heavy Hydrocarbon Residue; >540° C.) | 15 | 70 |
| C/H ratio | — | 6.64 |

Tables 6 and 7 show the predicted yield change for a unit processing 100,000 barrels per day (bbl/day) of AXL crude oil processed with or without the crude conditioning unit (CCU):

TABLE 6

AXL Crude Oil Simulation Results

| Product yields, simulated | AXL Assay without CCU [barrel/day] | AXL Assay with CCU [barrel/day] |
|---|---|---|
| C1-C4 (less than 70° C.) | 5512 | 9911 |
| Naphtha (C5-180)° C. | 31453 | 33617 |
| Kerosene (180° C.-220° C.) | 8405 | 12312 |
| Diesel (220° C.-350° C.) | 23051 | 27295 |
| Vacuum Gas Oil (350° C.-540° C.) | 16912 | 17867 |
| Heavy Hydrocarbon Residue (>540° C.) | 14666 | 9931 |

TABLE 7

KGC Simulation Results

| Product yields, [barrel/day] | KGC Assay w/o CCU [barrel/day] | KGC Assay w/CCU [barrel/day] |
|---|---|---|
| C1-C4 (less than 70° C.) | 3185 | 6708 |
| Naphtha (C5-180)° C. | 59040 | 60846 |
| Kerosene (180° C.-220° C.) | 11054 | 8990 |
| Diesel (220° C.-350° C.) | 20571 | 19156 |
| Vacuum Gas Oil (350° C.-540° C.) | 5708 | 4932 |
| Heavy Hydrocarbon Residue (>540° C.) | 441 | 391 |

As shown in Table 7, a significant increase in naphtha yield was observed following the processing of AXL crude oil in the crude conditioner unit. Additionally, the naphtha cuts from 70-220° C. showed an increase in the level of aromatic and naphthenic content as well as a reduction in paraffinic content from AXL crude oil processing. These results indicate both an increase in naphtha yields as compared to normal distillation and in the quality of naphtha produced, including naphtha aromatic species. The increased aromatic content produced in the resulting naphtha streams can, in some embodiments, be advantageously extracted using a benzene-toluene-ethylbenzene-xylenes (BTEX) extraction unit to isolate the valuable aromatics therein.

In addition, an improved diesel and related hydrocarbon fraction was observed. The "diesel cut" produced from AXL crude is beneficially higher in quality as compared to diesel produced, e.g. via crude oil distillation due to the very low to absent sulfur and other contaminants encountered in the distillation route. Similarly, the above referenced "naphtha cut" does not require treatment to remove sulfur and other contaminants as compared to naphtha produced using crude oil distillation.

With regards to KGC hydrocarbon processing, the naphtha yield is also advantageously increased upon processing this feed stream using the crude conditioner (hydroprocessing) unit. The naphtha cuts from 70° C. to 220° C. further exhibited a substantial increase in the level of aromatics produced as well as a reduction in paraffinic content upon hydroprocessing of KGC. The resulting aromatics can be easily extracted from the reactor effluent, in some embodiments, prior to sending naphtha to a catalytic reforming unit for further processing. The increased aromatic content in the naphtha streams can be extracted in an optional BTEX extraction unit, where naphthenic content may easily converted to aromatics in a catalytic naphtha reforming unit. As with AXL crude oil, the processed KGC also produced an improved diesel range yield or "diesel cut yield".

What is claimed is:

1. A method for producing an aromatics-rich system product from a wide boiling range condensate, the method comprising the steps of:

introducing the wide boiling range condensate and a high-purity hydrogen into a hydroprocessing reactor of an aromatics production system, where a volume ratio of the high-purity hydrogen to the wide boiling range condensate introduced is in a range up to 10:1;

operating the aromatics production system such that:

the hydroprocessing reactor forms both a light product gas mixture and a naphtha boiling temperature range liquid product, where the naphtha boiling temperature range liquid product consists of naphtha boiling temperature range liquid product components having true boiling point temperatures no greater than 220° C.;

the naphtha boiling temperature range liquid product passes to an aromatization reactor system and the light product gas mixture passes to a hydrogen extraction unit;

the aromatization reactor system forms the aromatics-rich system product, a hydrogen-rich gas product, and a non-aromatic liquid product, where the non-aromatic liquid product comprises $C_{9+}$ paraffins and naphthenes and less than 5 wt. % aromatics;

the hydrogen-rich gas product passes to the hydrogen extraction unit and at least a portion of the non-aromatic liquid product passes to the aromatization reactor system;

the hydrogen extraction unit forms the high-purity hydrogen and a mixed hydrogen-poor gas, where the mixed hydrogen-poor gas comprises no less than 70 wt. % $C_{1-5}$ alkanes; and the high-purity hydrogen passes to the hydroprocessing reactor.

2. The method of claim 1 where a portion of the wide boiling range condensate has a true boiling point (TBP) temperature greater than 233° C.

3. The method of claim 2 where the portion of the wide boiling range condensate comprises up to 75 wt. % of the wide boiling range condensate.

4. The method of claim 1 where the wide boiling range condensate has a final boiling point (FBP) temperature in a range of from about 400° C. to about 565° C.

5. The method of claim 1 where a portion of the wide boiling range condensate has a true boiling point (TBP) temperature of less than 25° C.

6. The method of claim 5 where the portion of the wide boiling range condensate comprises up to 20 wt. % of the wide boiling range condensate.

7. The method of claim 1 where the wide boiling range condensate comprises paraffins in a range of from 60 wt. % to 100 wt. % of the wide boiling range condensate.

8. The method of claim 1 where the wide boiling range condensate comprises naphthenes in a range of from 60 wt. % to 100 wt. % of the wide boiling range condensate.

9. The method of claim 1 where the wide boiling range condensate comprises aromatics in a range up to 40 wt. % of the wide boiling range condensate.

10. The method of claim 1 where the aromatics production system is operated such that the aromatics-rich system product comprises benzene in a range of from 2 wt. % to 30 wt. % of the aromatics-rich system product.

11. The method of claim 1 where the aromatics production system is operated such that the aromatics-rich system product comprises toluene in a range of from 10 wt. % to 40 wt. % of the aromatics-rich system product.

12. The method of claim 1 where the aromatics production system is operated such that the aromatics-rich system product comprises xylenes in a range of from 8 wt. % to 30 wt. % of the aromatics-rich system product.

13. The method of claim 1 further comprising the step of operating the aromatics production system such that the high-purity hydrogen also passes to the aromatization reactor system.

14. The method of claim 13 where the volume ratio of the high-purity hydrogen to the feeds introduced into the aromatization reactor system is maintained in a range up to 6.

15. The method of claim 1 where the aromatics production system is operated such that all of the non-aromatic liquid product produced by the aromatization reactor system is reintroduced into the aromatization reactor system.

16. The method of claim 1 where the aromatics production system is operated such that at least a portion of the non-aromatic liquid product passes to the hydroprocessing reactor.

* * * * *